US010976062B2

(12) United States Patent
Wang et al.

(10) Patent No.: US 10,976,062 B2
(45) Date of Patent: Apr. 13, 2021

(54) COOLING DEVICE FOR AIR CONDITIONER CIRCUIT BOARD

(71) Applicant: Qingdao Haier Air Conditioner General Corp., Ltd., Shandong (CN)

(72) Inventors: Fei Wang, Shandong (CN); Baohua Gao, Shandong (CN); Yu Fu, Shandong (CN); Mingjie Zhang, Shandong (CN)

(73) Assignee: Qingdao Haier Air Conditioner General Corp., Ltd., Shandong (CN)

( * ) Notice: Subject to any disclaimer, the term of this patent is extended or adjusted under 35 U.S.C. 154(b) by 25 days.

(21) Appl. No.: 16/165,349

(22) Filed: Oct. 19, 2018

(65) Prior Publication Data

US 2019/0049124 A1 Feb. 14, 2019

Related U.S. Application Data

(63) Continuation of application No. PCT/CN2017/074063, filed on Feb. 20, 2017.

(30) Foreign Application Priority Data

Jun. 12, 2016 (CN) ..... 201610408066.3

(51) Int. Cl.
*F24F 1/24* (2011.01)
*F24F 13/30* (2006.01)
(Continued)

(52) U.S. Cl.
CPC ..... *F24F 1/24* (2013.01); *F24F 1/26* (2013.01); *F24F 13/30* (2013.01); *F28F 3/12* (2013.01);
(Continued)

(58) Field of Classification Search
CPC combination set(s) only.
See application file for complete search history.

(56) References Cited

U.S. PATENT DOCUMENTS 5,199,487 A 4/1993 DiFrancesco et al.
6,213,195 B1 4/2001 Downing et al.
(Continued)

FOREIGN PATENT DOCUMENTS

CN 103912928 A 7/2014
CN 103912930 A 7/2014
(Continued)

OTHER PUBLICATIONS

Office Action from Chinese Application No. 201610408066.3 dated Oct. 8, 2018.
(Continued)

*Primary Examiner* — Joseph F Trpisovsky
(74) *Attorney, Agent, or Firm* — Marshall, Gerstein & Borun LLP

(57) ABSTRACT

A cooling device for air conditioner circuit board includes a compressor, an outdoor heat exchanger, a gas-liquid separator, and an indoor heat exchanger which are connected in sequence. A gas outlet end of the gas-liquid separator is communicatively coupled with a gas suction port of the compressor through a cooling pipeline, and a cooling equipment for cooling the air conditioner circuit board is provided on the cooling pipeline.

8 Claims, 4 Drawing Sheets

(51) Int. Cl.

| | |
|---|---|
| ***F28F 3/12*** | (2006.01) |
| ***F24F 1/26*** | (2011.01) |
| *F28D 21/00* | (2006.01) |
| *F24F 140/50* | (2018.01) |
| *F24F 110/12* | (2018.01) |

(52) U.S. Cl.
CPC ..... *F24F 2110/12* (2018.01); *F24F 2140/50* (2018.01); *F28D 2021/0029* (2013.01)

(56) References Cited

U.S. PATENT DOCUMENTS

| | | | | |
|---|---|---|---|---|
| 6,952,346 | B2 * | 10/2005 | Tilton | H05K 7/20345 165/80.4 |
| 7,017,353 | B2 * | 3/2006 | Gist | F25B 41/043 62/277 |
| 7,757,497 | B1 * | 7/2010 | Pautsch | F28D 3/04 165/104.33 |
| 8,944,151 | B2 * | 2/2015 | Flotta | H01L 23/4735 165/104.21 |
| 2016/0054077 | A1 * | 2/2016 | Saito | F25B 39/00 |

FOREIGN PATENT DOCUMENTS

| | | | |
|---|---|---|---|
| CN | 104833013 | A | 8/2015 |
| CN | 104896785 | A | 9/2015 |
| CN | 105157127 | A | 12/2015 |
| CN | 204923543 | U | 12/2015 |
| CN | 204962968 | U | 1/2016 |
| CN | 204963284 | U | 1/2016 |
| CN | 205037475 | U | 2/2016 |
| CN | 106016505 | A | 10/2016 |
| JP | 2008057856 | A | 3/2008 |
| JP | 2015218939 | * | 12/2015 |
| JP | 2015218939 | A | 12/2015 |

OTHER PUBLICATIONS

Written Opinion from International Application No. PCT/CN2017/074063 dated May 24, 2017.
Search Report from European Application No. 17812399.8 dated Jun. 24, 2019.
Search Report from International Application No. PCT/CN2017/074063 dated May 24, 2017.

* cited by examiner

COOLING DEVICE FOR AIR CONDITIONER CIRCUIT BOARD

CROSS-REFERENCE TO RELATED APPLICATION

The present disclosure is a continuation application of PCT application No. PCT/CN2017/074063 filed on Feb. 20, 2017 which is based on and claims a priority of the Chinese Patent Application No. 201610408066.3 filed on Jun. 12, 2016, the disclosures of which are incorporated in their entirety as reference herein.

FIELD

The present disclosure relates to the field of air conditioner technologies, and in particular, to a cooling device for air conditioner circuit board.

BACKGROUND

In hot weather, a user needs a relatively high refrigerating capacity to make himself or herself comfortable. However, the current air conditioner with a coolant circulating system is restricted in some conditions. For example, at a high temperature ambient, a coolant pressure of the air conditioner is high, a system load thereof is high and an overall current thereof is also high, so that a chip module board of a transducer has a high temperature. For the sake of running security of the air conditioner, when the chip module board of the transducer reaches a predetermined temperature, in order to protect a semiconductor chip, the air conditioner would lower its frequency, so as to reduce the heat of the chip module board. However, the reduction in frequency of the air conditioner may cause the decrease in refrigerating capacity, thereby affecting a comfort degree of the user.

SUMMARY

An object of the present disclosure is to provide a cooling device for air conditioner circuit board, so as to solve the problem in the prior art that the user comfort degree may be affected because frequency and heat exchange amount of an air conditioner cannot be coordinated.

According to one aspect of the present disclosure, there is provided a cooling device for air conditioner circuit board, including a compressor, an outdoor heat exchanger, a gas-liquid separator, and an indoor heat exchanger which are connected in sequence. A gas outlet end of the gas-liquid separator is communicatively coupled with a gas suction port of the compressor by means of a cooling pipeline, and a cooling equipment for cooling the air conditioner circuit board is provided on the cooling pipeline.

BRIEF DESCRIPTION OF THE DRAWINGS

The accompanying drawings, which are to provide a further understanding of the disclosure, constitute a part of this application. The schematic embodiments of the present disclosure and its specification are used to explain the present disclosure, instead of improperly limiting the present disclosure.

REFERENCE NUMERALS

Figure 1:
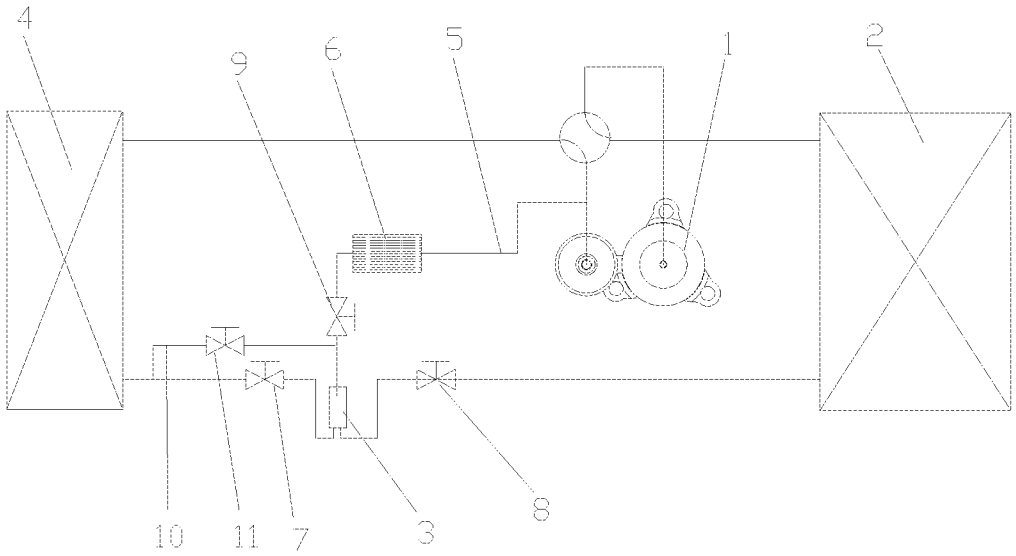
FIG. 1 is a structural schematic diagram of a cooling device for air conditioner circuit board according to some embodiments of the present disclosure.

1. compressor; 2. outdoor heat exchanger; 3. gas-liquid separator; 4. indoor heat exchanger; 5. cooling pipeline; 6. cooling equipment; 7. first throttling device; 8. second throttling device; 9. third throttling device; 10. by-pass pipeline; 11. flow regulating valve; 12. casing; 13. partition plate; 14. receiving chamber; 15. communicating hole; 16. inlet (cooling equipment); 17. outlet (cooling equipment).

DETAILED DESCRIPTION OF THE EMBODIMENTS

In the following detailed descriptions, a large amount of specific details are provided, so as to provide a thorough understanding of the present disclosure. However, persons skilled in the art would understand that the present disclosure may be implemented even if there are no such specific details. In other cases, the well-known method, process, assembly and circuit are not described in detail, so as to avoid the understanding of the present disclosure from being affected.

With reference to FIGS. 1-9, according to some embodiments of the present disclosure, the cooling device for air conditioner circuit board includes a compressor 1, an outdoor heat exchanger 2, a gas-liquid separator 3, and an indoor heat exchanger 4 which are connected in sequence. A gas outlet end of the gas-liquid separator 3 is communicatively coupled with a gas suction port of the compressor 1 through a cooling pipeline 5, and a cooling equipment 6 for cooling the air conditioner circuit board is provided on the cooling pipeline 5.

When the cooling device for air conditioner circuit board operates, a gas-liquid separation may be performed on the refrigerant by the gas-liquid separator 3, such that the liquid refrigerant keeps taking effect in the subsequent heat exchange, and the gaseous refrigerant may pass through the cooling pipeline 5 to cool the air conditioner circuit board, and then flows back to the gas suction port of the compressor 1, thereby effectively dissipating the heat of the air conditioner circuit board while lowering the influence on the subsequent cooling or heating effects. Thus, the running frequency and the heat exchange amount of the air conditioner may be coordinated, so that the refrigerating or heating capacity of the air conditioner is ensured, thereby improving the comfort degree of the user. Meanwhile, the gaseous refrigerant passing through the cooling pipeline 5 may also be mixed with that flowing out from the indoor heat exchanger or the outdoor heat exchanger, so as to reduce the temperature of the gaseous refrigerant entering the compressor 1, thereby improving the working efficiency of the compressor 1.

A first throttling device 7 is arranged between the indoor heat exchanger 4 and the gas-liquid separator 3; and/or, a second throttling device 8 is arranged between the outdoor heat exchanger 2 and the gas-liquid separator 3. In one embodiment, the throttling devices are arranged between the indoor heat exchanger 4 and the gas-liquid separator 3 as well as between the outdoor heat exchanger 2 and the gas-liquid separator 3. As such, no matter the air conditioner operates in cooling mode or in heating mode, the refrigerant may be decompressed by the throttling device before entering the gas-liquid separator 3, such that an adequate amount of gaseous refrigerant may be generated in the gas-liquid separator 3, and be used in a process of cooling the air conditioner circuit board by the cooling equipment 6, so as to ensure the cooling effect of the air conditioner circuit board.

With reference to FIG. 1, in the cooling device for air conditioner circuit board according to some embodiments of the present disclosure, a third throttling device 9 is arranged between the gas outlet end of the gas-liquid separator 3 and the cooling equipment 6. The third throttling device 9 may further reduce the pressure and temperature of the refrigerant entering the cooling pipeline 5, may reduce the temperature of the gaseous refrigerant, so as to improve the heat exchange efficiency of the gaseous refrigerant with the air conditioner circuit board, thereby enhancing the heat exchange performance of the cooling equipment 6.

Figure 7:
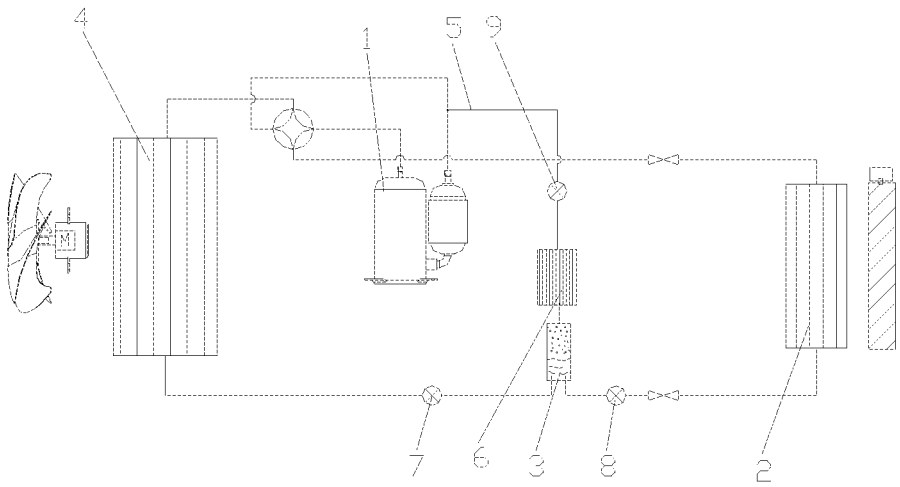
FIG. 7 is a structural schematic diagram of the cooling device for air conditioner circuit board according to some embodiments of the present disclosure.

Alternatively, in the cooling device for air conditioner circuit board according to some embodiments of the present disclosure with reference to FIG. 7, the third throttling device 9 may be arranged between the cooling equipment 6 and the gas suction port of the compressor 1.

In some embodiments, a by-pass pipeline 10 may further be arranged between the gas outlet end of the gas-liquid separator 3 and the indoor heat exchanger 4, and a flow regulating valve 11 is arranged on the by-pass pipeline 10. The flow of the gaseous refrigerant entering the cooling equipment 6 from the gas outlet end of the gas-liquid separator 3 may be regulated by the by-pass pipeline 10, thereby regulating the amount of the gaseous refrigerant which flows back to the gas suction port of the compressor 1 after exchanging heat with the air conditioner circuit board via the cooling equipment 6, so as to ensure that the amount of refrigerant entering the indoor heat exchanger 4 or the outdoor heat exchanger 2 is adequate, thereby ensuring the good heat exchange efficiency of the refrigerant with the indoor heat exchanger 4 or the outdoor heat exchanger 2.

In some embodiments, the cooling equipment 6 is a parallel flow heat exchanger which has a plate-type micro channel, with good heat exchange effects, thereby improving the heat exchange efficiency of the gaseous refrigerant with the air conditioner circuit board. The air conditioner circuit board is disposed on the parallel flow heat exchanger. The gaseous refrigerant exchanges heat with the air conditioner circuit board, and then directly returns back to the gas suction port of the compressor 1.

Figure 2:
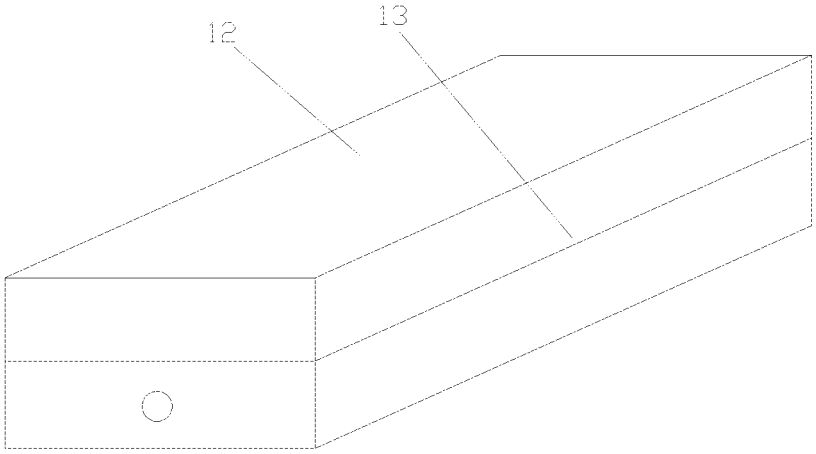
FIG. 2 is a perspective diagram of a cooling equipment of the cooling device for air conditioner circuit board according to some embodiments of the present disclosure.
Figure 3:
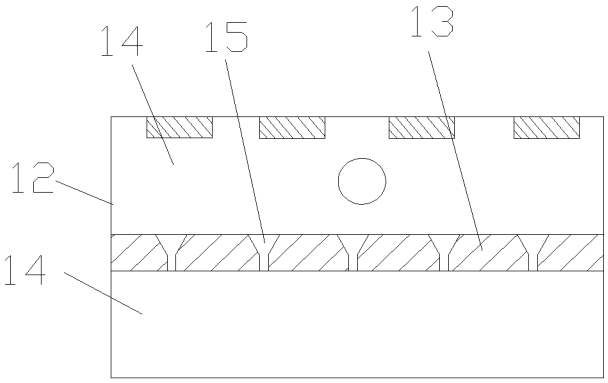
FIG. 3 is a transverse section view of the cooling equipment of the cooling device for air conditioner circuit board according to some embodiments of the present disclosure.
Figure 4:
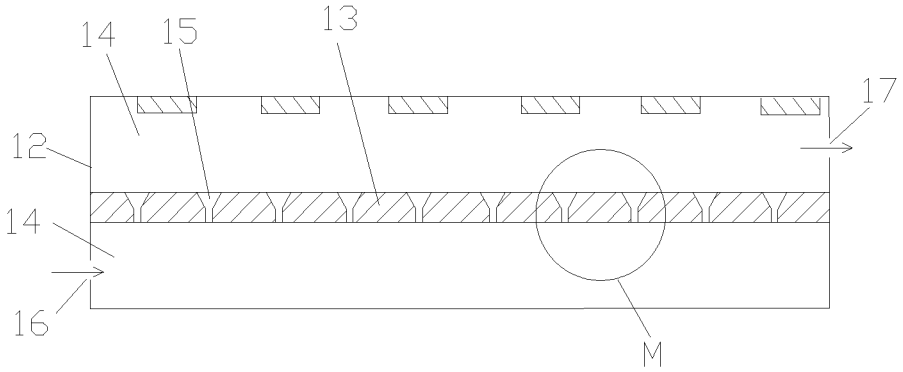
FIG. 4 is a longitudinal section view of the cooling device for air conditioner circuit board according to some embodiments of the present disclosure.

With reference to FIGS. 2-4, the cooling equipment 6 may also have the following structure in some embodiments. The cooling equipment 6 includes a casing 12 and a partition plate 13 arranged in the casing 12. The partition plate 13 divides the casing 12 into two separated receiving chambers 14, an inlet 16 of the cooling equipment 6 is communicatively coupled with one of the receiving chambers 14, and an outlet 17 of the cooling equipment 6 is communicatively coupled with the other receiving chamber 14. A communication hole 15, which is open towards a direction where the air conditioner circuit board is, is arranged on the partition plate 13. The gaseous refrigerant enters the one of the receiving chambers 14 via the inlet 16 of the cooling equipment 6, and then enters the other of the receiving chambers 14 from the communication hole 15 on the partition plate 13. During this process, the flow direction of the gaseous refrigerant is changed, so that the gaseous refrigerant impacts a side wall of the casing 12 close to the air conditioner circuit board, thereby making the gaseous refrigerant adequately contact with the side wall of the casing, and improving the heat exchange efficiency of the casing 12 with the air conditioner circuit board. Meanwhile, when the gaseous refrigerant impacts the side wall of the casing 12, a turbulent flow or a turbulence is generated, which makes the gaseous refrigerant flowing through the receiving chamber 14 at this side more adequately contact with the side wall of the casing 12, and further improves the heat exchange efficiency of the gaseous refrigerant with the air conditioner circuit board. The gaseous refrigerant exchanges heat with the air conditioner circuit board fully, and then flows back to the gas suction port of the compressor 1 from the outlet 17 of the cooling equipment 6.

Figure 5:
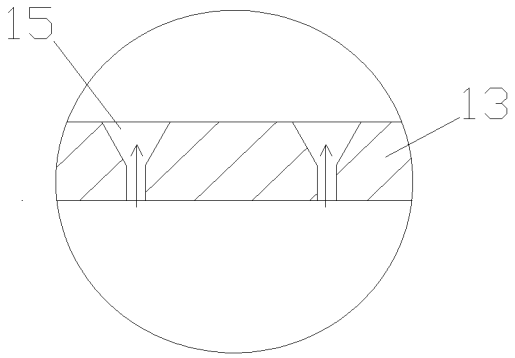
FIG. 5 is a partial enlarged view of M in FIG. 4.

In some embodiments, with reference to FIG. 5, an opening area of the communicating hole 15 increases gradually along the flow direction of the refrigerant, such that an outlet area of the communicating hole 15 through which the gaseous refrigerant passes is increased, which may increase the contact area of the gaseous refrigerant with the side wall of the casing 12, thereby improving the heat exchange efficiency.

Figure 6:
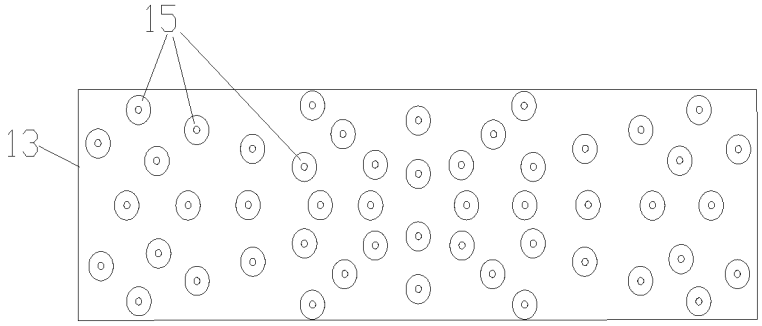
FIG. 6 is a distribution view of a communication hold arranged on a partition plate according to some embodiments of the present disclosure.

In some embodiments, with reference to FIG. 6, a plurality of communicating holes 15 is distributed on the partition plate 13 radially, which realizes more reasonable distribution of the communicating holes 15 on the partition plate 13. The gaseous refrigerant distributes more evenly when entering the other receiving chamber 14 from one receiving chamber 14, with higher heat exchange efficiency.

In some embodiments, with reference to FIGS. 3-4, the side wall of the casing 12 close to the air conditioner circuit board has an uneven inner surface, which may further increase the contact area of the gaseous refrigerant in the receiving chamber 14 with the inner surface of the side wall of the casing 12, thereby improving the heat exchange efficiency.

Hereinafter, the working process of the cooling device for the air conditioner circuit board when the air conditioner is for cooling will be explained.

Having discharged from a gas discharge end of the compressor 1, the refrigerant is condensed by the outdoor heat exchanger 2, and then is throttled and decompressed by the second throttling device 8, becoming vapor-liquid phases. The refrigerant in the two-phase state enters in the gas-liquid separator 3. The gaseous refrigerant enters the cooling pipeline 5 from the gas outlet end of the gas-liquid separator 3. The gaseous refrigerant flows through the cooling equipment 6 and exchanges heat with the air conditioner circuit board, and then flows back to the gas suction port of the compressor 1. The liquid refrigerant in the gas-liquid separator 3 exits from the liquid outlet of the gas-liquid separator 3, is throttled and decompressed by the first throttling device 7, enters the indoor heat exchanger 4 to exchange heat, and then flows back to the gas suction port of the compressor 1 via a four-way valve. In this process, the amount of gaseous refrigerant flowing through the cooling equipment 6 may be regulated by regulating the flow regulating valve 11 on the by-pass pipeline 10. In this manner, it is possible to reduce the temperature of the gas suction port of the compressor 1 effectively, and improve the working efficiency of the compressor 1.

As for the refrigerant in the cooling device for the air conditioner circuit board, particularly the new environmental R32 refrigerant, its properties cause a discharge temperature to be higher than that of the R410A refrigerant by 10°-15° C. The discharge temperature cannot be reduced efficiently, which leads to the frequent ON/OFF of the compressor due to the high temperature protection, and shortens service life. With the control over the third throttling device 9, the gas suctioned by the compressor 1 contains a certain amount of liquid refrigerant, thereby effectively reducing the temperature of the discharged gas. According to the test, the cooling effect was significant when the refrigerant at the gas suction port of the compressor had a dryness of 0.65 to 0.8.

The process of the cooling device for the air conditioner circuit board when the air conditioner is for heating is reverse to that when the air conditioner is for cooling. During the heating process, the gaseous refrigerant flows back to the gas suction port of the compressor 1 from the cooling pipeline 5, which not only increases the refrigerant flow, but also has the effects of supplying gas and adding enthalpy. In this state, the refrigerant entering the outdoor heat exchanger 2 is closer to the liquid phase, with a reduced loss of pressure and increased suction pressure compared with that in the two-phase state, such that the refrigerant cycle amount is increased. The lower the outdoor temperature, the greater the advantage of the increased suction pressure in the condition of heating. The density of superheated steam is increased remarkably. The higher the increasing ratio of the refrigerant cycle amount, the greater the degree of heating capacity increase. The refrigerant steam with a high dryness is injected into the gas suction port, and the suction specific enthalpy is increased, which may effectively increase the heating capacity.

Figure 8:
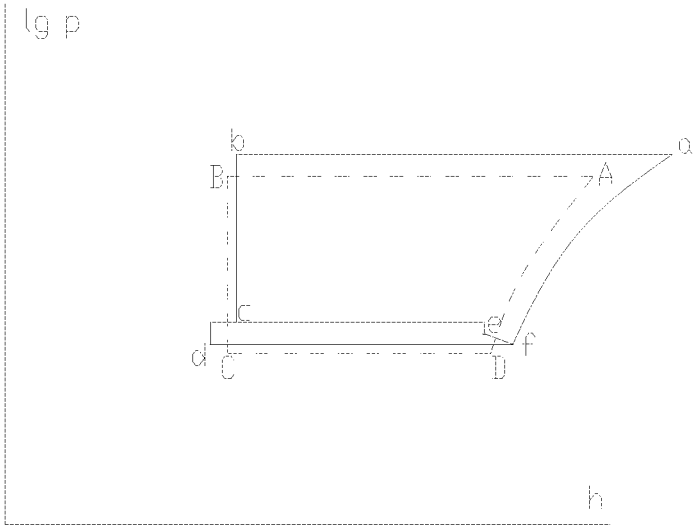
FIG. 8 is a P-h refrigerant cycle diagram of the cooling device for air conditioner circuit board according to some embodiments of the present disclosure.
Figure 9:
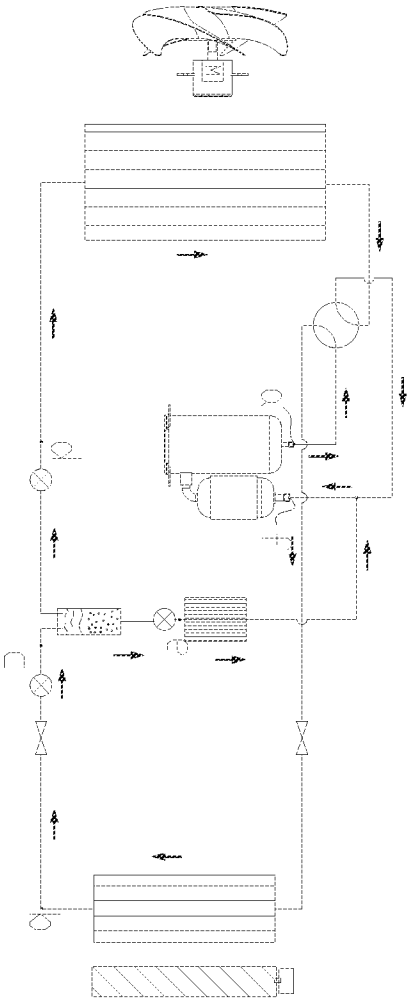
FIG. 9 is a refrigerant cycle schematic diagram of the cooling device for air conditioner circuit board according to some embodiments of the present disclosure.

FIGS. 8 and 9 are refrigerant cycle schematic diagrams when the cooling device for air conditioner circuit board is for heating. The solid line in FIG. 8 is a refrigerant P-h cycle diagram of the present disclosure, and the dashed line is the refrigerant P-h cycle diagram of the related art. It can be seen from the diagrams that an increase in the gas suction pressure causes an increase in the specific volume back to the compressor by using the technical solution according to some embodiments of the present disclosure. Meanwhile, from the point e to the point f, the refrigerant absorbs the heat dissipated from the air conditioner circuit board, thereby increasing the enthalpy difference from the point a to the point b. Thus, the heating capacity of the air conditioner is increased notably and the power efficiency of the air conditioner is improved remarkably.

The cooling device for air conditioner circuit board according to the present disclosure includes a compressor, an outdoor heat exchanger, a gas-liquid separator, and an indoor heat exchanger which are connected in sequence. A gas outlet end of the gas-liquid separator is communicatively coupled with a gas suction port of the compressor by means of a cooling pipeline, and a cooling equipment for cooling the air conditioner circuit board is provided on the cooling pipeline. When the cooling device for air conditioner circuit board operates, it is possible to perform gas-liquid separation on the refrigerant by means of the gas-liquid separator, such that the liquid refrigerant keeps taking effect in the subsequent heat exchange, and the gaseous refrigerant may pass through the cooling pipeline to cool the air conditioner circuit board, and then flows back to the gas suction port of the compressor, thereby effectively cooling the air conditioner circuit board while lowering the influence on the subsequent cooling or heating effects, such that the running frequency and the heat exchange amount of the air conditioner can be coordinated, the refrigerating or heating capacity of the air conditioner is ensured, and the user comfort degree is improved.

The foregoing description of the embodiments is merely to help understand the method and core concepts of the present disclosure. Meanwhile, for persons skilled in the art, according to the concepts of the present disclosure, the specific embodiments and its application scope would be amended. To sum up, the contents of the present specification should not be construed as the limit to the present disclosure.

What is claimed is:

1. A cooling device for air conditioner circuit board, the cooling device comprising: a compressor, an outdoor heat exchanger, a gas-liquid separator, and an indoor heat exchanger which are connected in sequence, wherein a gas outlet end of the gas-liquid separator is communicatively coupled with a gas suction port of the compressor by means of a cooling pipeline, and wherein a cooling equipment for cooling the air conditioner circuit board is provided on the cooling pipeline, wherein the cooling equipment comprises a casing and a partition plate arranged in the casing, the partition plate divides the casing into two separated receiving chambers, an inlet of the cooling equipment is communicatively coupled with one of the receiving chambers, and an outlet of the cooling equipment is communicatively coupled with the other receiving chamber, and a communicating hole, which is open towards a direction where the air conditioner circuit board is, is arranged on the partition plate, wherein the communicating hole extends continuously between the two separated receiving chambers and has an opening area that increases gradually along a refrigerant flow direction.

2. The cooling device for air conditioner circuit board according to claim 1, further comprising:

a first throttling device arranged between the indoor heat exchanger and the gas-liquid separator; and/or a second throttling device arranged between the outdoor heat exchanger and the gas-liquid separator.

3. The cooling device for air conditioner circuit board according to claim 2, further comprising: a third throttling device arranged between a gas outlet end of the gas-liquid separator and the cooling equipment.

4. The cooling device for air conditioner circuit board according to claim 1, further comprising:

a by-pass pipeline arranged between the gas outlet end of the gas-liquid separator and the indoor heat exchanger; and a flow regulating valve arranged on the by-pass pipeline.

5. The cooling device for air conditioner circuit board according to claim 1, wherein the cooling equipment is a parallel flow heat exchanger.

6. The cooling device for air conditioner circuit board according to claim 1, wherein a plurality of communicating holes is distributed on the partition plate radially.

7. The cooling device for air conditioner circuit board according to claim 1, wherein a side wall of the casing close to the air conditioner circuit board has an uneven inner surface.

8. The cooling device for air conditioner circuit board according to claim 2, further comprising:

a third throttling device arranged between the cooling equipment and the gas suction port of the compressor.

* * * * *